US008647045B1

(12) United States Patent
Wagoner

(10) Patent No.: US 8,647,045 B1
(45) Date of Patent: Feb. 11, 2014

(54) EXTENDO BUCKET ATTACHMENT

(76) Inventor: Scott B. Wagoner, Maricopa, AZ (US)

( * ) Notice: Subject to any disclaimer, the term of this patent is extended or adjusted under 35 U.S.C. 154(b) by 776 days.

(21) Appl. No.: 12/806,221

(22) Filed: Aug. 9, 2010

Related U.S. Application Data

(60) Provisional application No. 61/273,970, filed on Aug. 12, 2009.

(51) Int. Cl.
*E02F 3/34* (2006.01)

(52) U.S. Cl.
USPC ..... 414/692; 414/723; 37/416; 37/428

(58) Field of Classification Search
CPC ..... E02F 3/303; E02F 3/3417; E02F 3/3677
USPC ..... 37/416, 428; 414/686, 692, 723, 724, 414/641, 642, 425
See application file for complete search history.

(56) References Cited

U.S. PATENT DOCUMENTS

| | | | | |
|---|---|---|---|---|
| 3,705,656 | A | 12/1972 | Hunger et al. | |
| 3,794,191 | A * | 2/1974 | Kuhn | 414/711 |
| 4,080,746 | A | 3/1978 | Frazzini | |
| 5,580,208 | A * | 12/1996 | Miller, Sr. | 414/703 |
| 6,474,933 | B1 | 11/2002 | Hoechst et al. | |
| 6,578,297 | B1 | 6/2003 | Forsberg | |
| 7,226,267 | B2 * | 6/2007 | Johnston | 414/607 |

* cited by examiner

*Primary Examiner* — Saul Rodriguez
*Assistant Examiner* — Brendan Tighe
(74) *Attorney, Agent, or Firm* — Harpman & Harpman

(57) ABSTRACT

A bucket attachment for skid loaders and the like that provides a forward hinge material bucket that effectively extends the usable load height for the bucket. The bucket attachment affords loading material into higher trucks using the same skid loader by a uniquely positioned bucket dual pivot system.

4 Claims, 4 Drawing Sheets

EXTENDO BUCKET ATTACHMENT

This application claims the benefit of U.S. Provisional Application No. 61/273,970, filed on Aug. 12, 2009.

BACKGROUND OF THE INVENTION

1. Technical Field

This device relates to loader buckets that are mounted on the end of hydraulically activated booms of wheeled loader type vehicles.

2. Description of Prior Art

Prior art loader buckets have been provided for a different boom and front loader hydraulic arm assemblies that allow for the collection, moving and dumping of bucket material contents typically within a truck or other type of wheeled conveyance. Such bucket attachments are hydraulically operated having fixed pivot points and attached hydraulic piston arm so that the bucket can be pivoted to vertical position dumping the contents therein, see for example U.S. Pat. Nos. 3,705,656, 4,080,746, 6,474,933 and 6,578,297.

In U.S. Pat. No. 3,705,656, a bucket attachment is disclosed having transversely mounted pair of hydraulic cylinders with rods extending from both ends for registerable engagement within sockets on the bucket for quick removal and mounting.

U.S. Pat. No. 4,080,746 discloses a loader bucket for earth working equipment having a pivoted arm assembly connected to the bucket assembly for pivoting the bucket from a mid forward point on the bucket.

U.S. Pat. No. 6,474,933 claims an extended reach vertical lift boom wherein a bucket attachment is provided on the end of the loader arms with a piston and cylinder assembly mounted thereabove and to the bucket.

Finally, U.S. Pat. No. 6,578,297 discloses a skidder attachment and sub-attachment for earth moving equipment bucket. The bucket is pivotally secured to the load arms at its back lower corners with a piston and cylinder totally secured thereabout allowing for tilting and unloading the bucket contents on the end of a power activated boom.

SUMMARY OF THE INVENTION

A unique bucket attachment for front loaders, skid loaders and other earth moving machines. The bucket attachment is secured to the arm's end with a bucket support frame having a pair of hydraulic piston and cylinder assemblies thereon. The bucket attachment is pivoted from front side mounts with a main arm pivot and a piston rod actuated pivot position thereabove allowing for a front end pivot of the bucket from the attachment mounting frame.

DETAILED DESCRIPTION OF THE INVENTION

Figure 1:
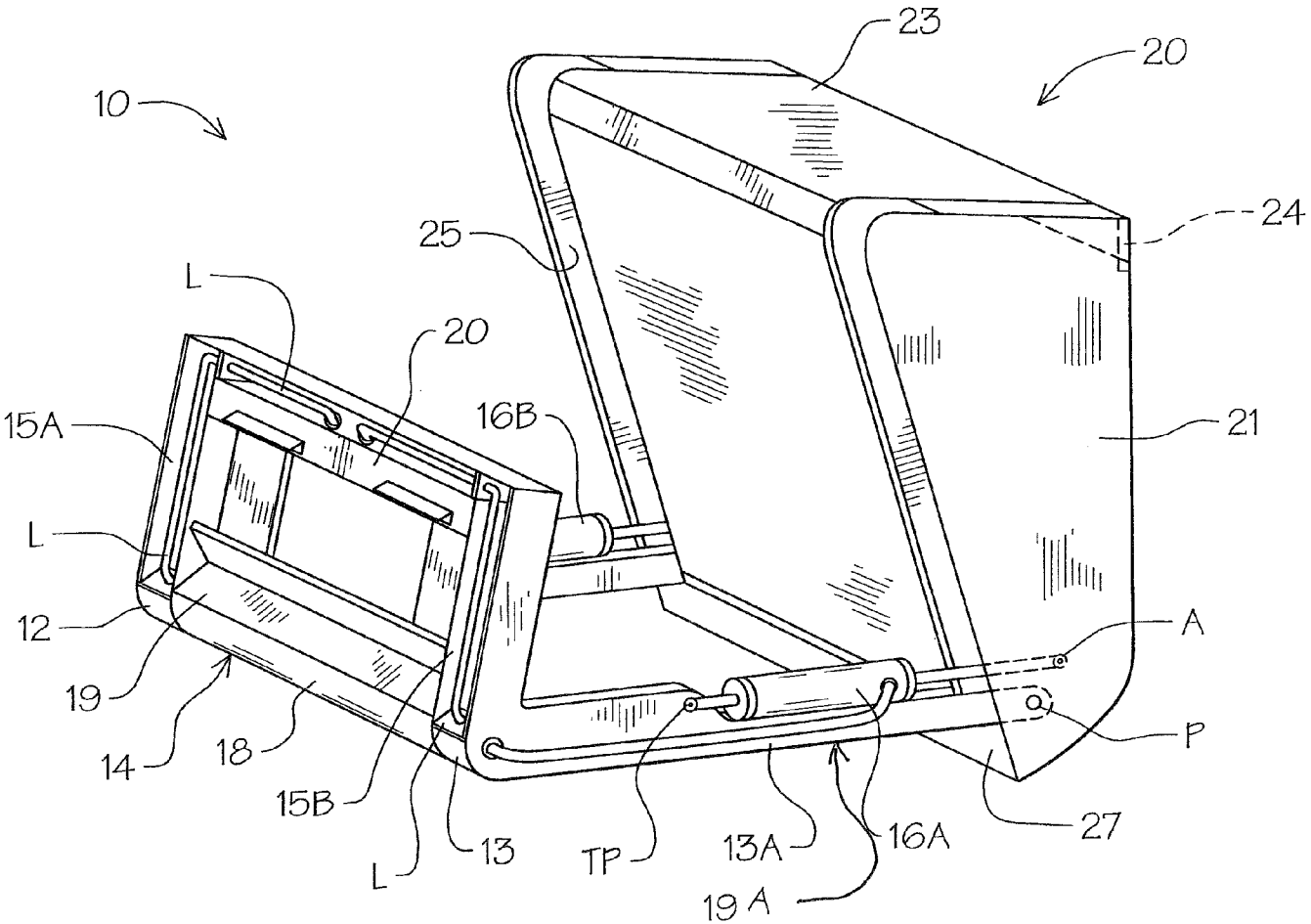
FIG. 1 is a perspective view of the bucket attachment in open dumped position.
Figure 2:
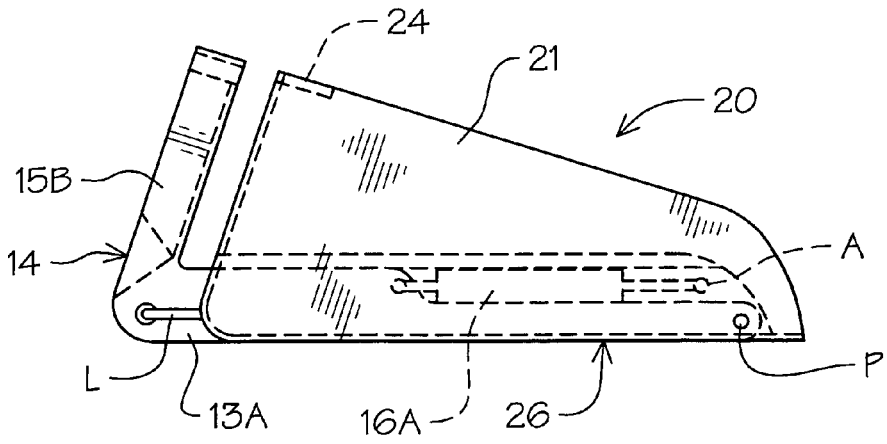
FIG. 2 is a side elevational view of the bucket attachment in down closed position.
Figure 3:
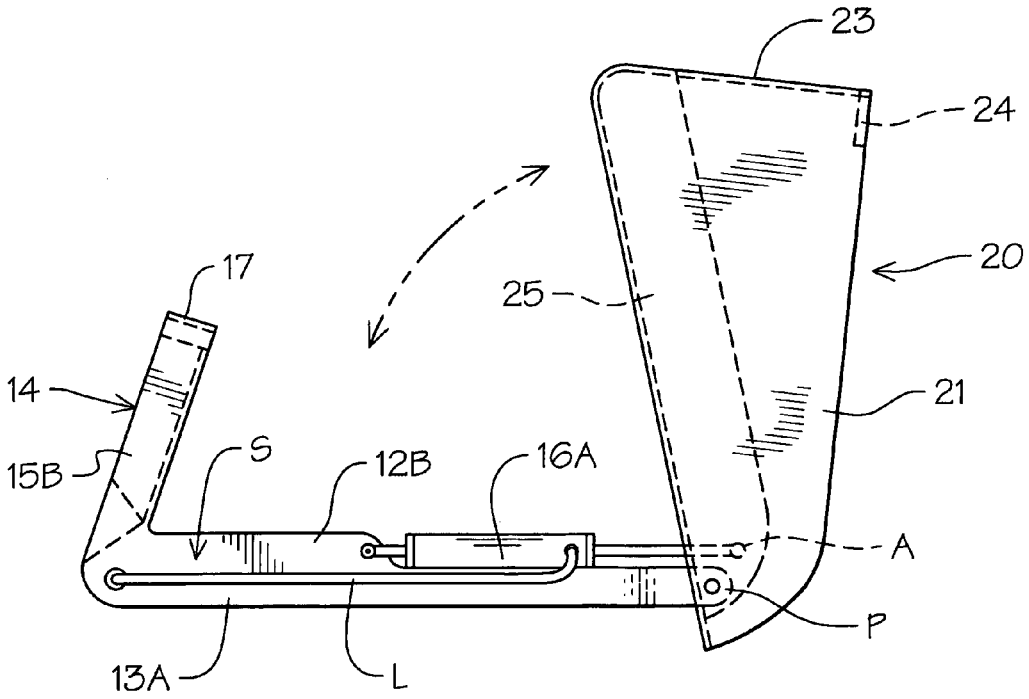
FIG. 3 is a side elevational view of the bucket attachment in open pivoted extended dump position.

Referring to FIGS. 1, 2 and 3 of the drawings, a hydraulic bucket attachment 10 of the invention can be seen having a main support frame 11 with a pair of L-shaped arm supports 12 and 13 extending in spaced parallel relation to one another. A center equipment mounting assembly frame 14 extends between vertical sections 15A and 15B of the arm supports 12 and 13, best seen in FIG. 1 of the drawings. The arm supports 12 and 13 are identical having horizontally extending arm portions 12A and 13A, each with a pivoted mounting bucket activation piston and cylinder assembly 16A and 16B thereon.

The respective free ends of the arm portions 12A and 13A are apertured with a main bucket pivot mounting pin P therein as will be described in greater detail hereinafter.

Figure 6:
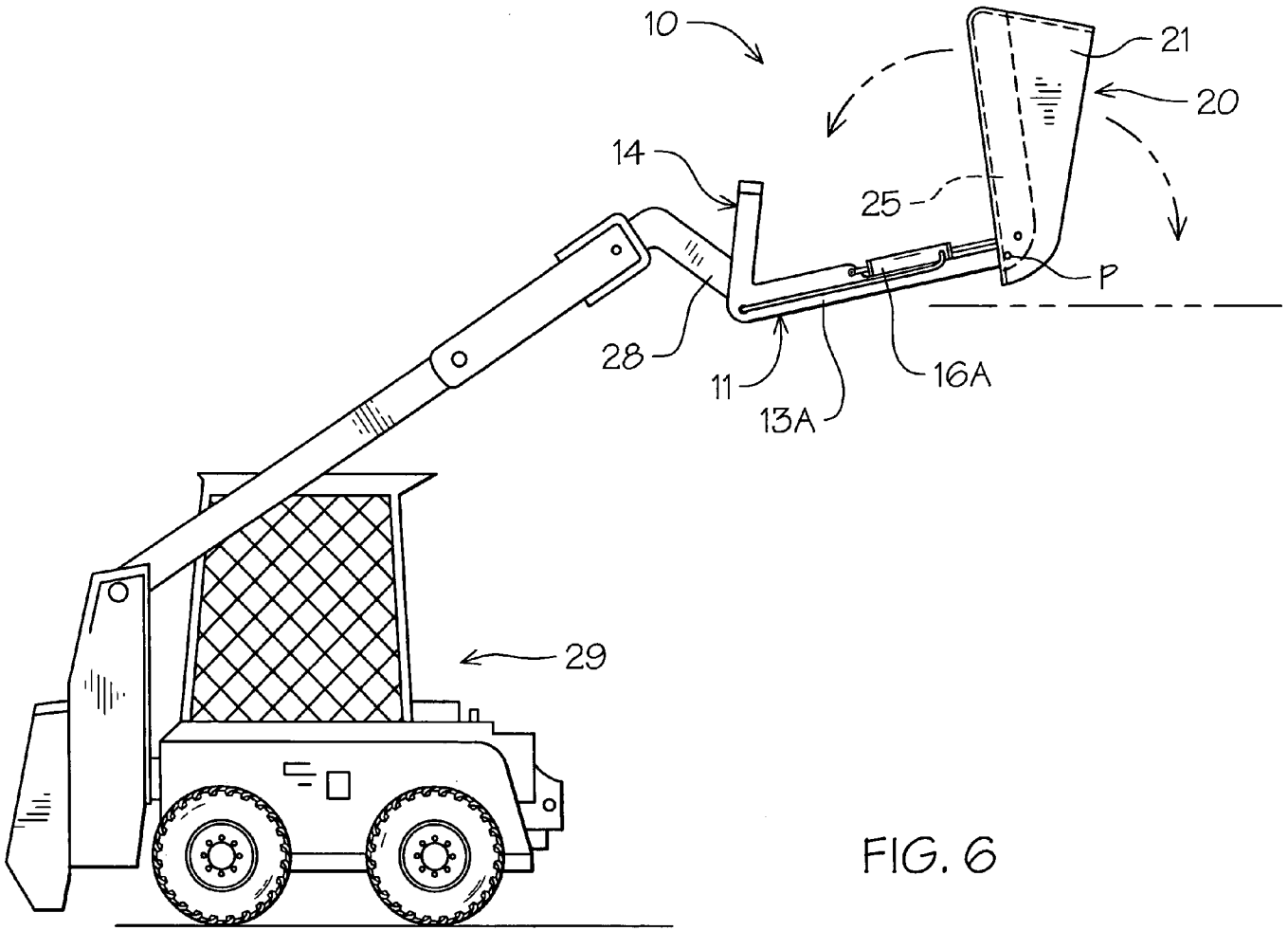
FIG. 6 is a side elevational view showing the bucket attachment on a loader in extended pivoted dump position during use.

The central equipment mounting assembly 14, best seen in FIGS. 1 and 6 of the drawings has a pair of vertically spaced transverse frame members 17 and 18 with reinforcing plates 19 and 20 extending therebetween in abutting relationship to said respective vertical bucket arm sections 15A and 15B. Openings are provided for hydraulic fluid lines L which extend along the respective outside surfaces S of the arm supports 12 and 13 to the aforedescribed piston and cylinder assemblies 16A and 16B thereon. It will be noted that each of the extending arm portions 12A and 13B have an area of reduced cross-sectional dimension at 19A to provide mounting space for the piston and cylinder assemblies 16A and 16B which are pivotally secured to the respective arm portions 12A and 13A at the reduced transition vertical dimension point TP.

Figure 4:
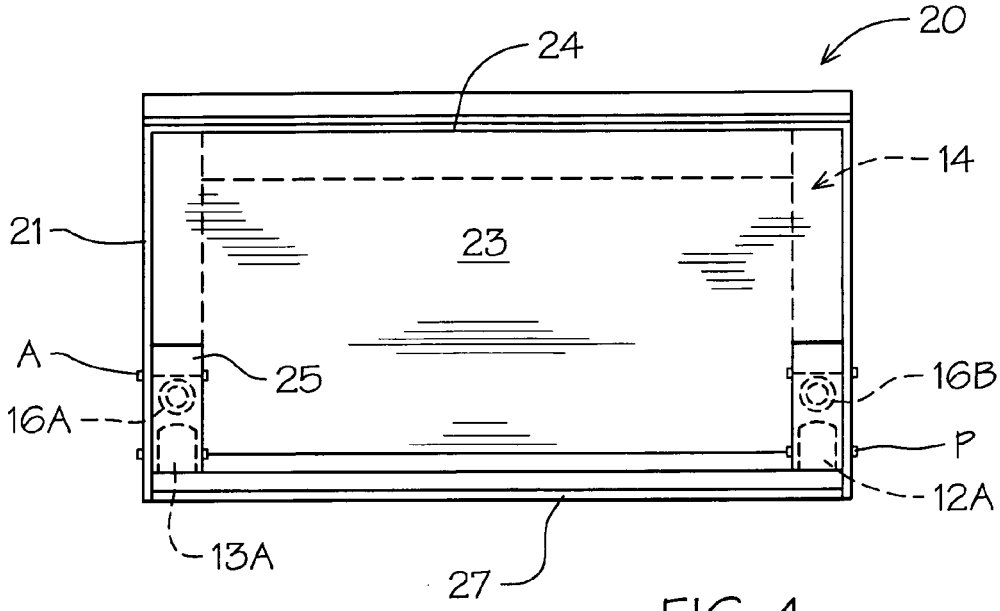
FIG. 4 is a front elevational view thereof.

Referring now to FIGS. 1, 2 and 4 of the drawings, a material load bucket 20 can be seen pivotally attached to the hereinbefore described arm portions 12A and 12B of, the main support frame 11. The bucket 20 has oppositely disposed spaced parallel sidewalls 21 and 22 interconnected with a back wall 23 and reinforcing top plate 24 thereacross. Each of the sidewalls 21 and 22 has an elongated frame receiving pocket channel 25 extending from a base bucket bottom plate 26 interconnecting the respective sidewalls 21 and 22 and back wall 23 into an integral structural configuration. The frame pocket chambers 25 are closed within the bucket area with their respective open channels facing downwardly and are so aligned to receive the respective arm portions 12A and 12B with their respective piston and cylinder assemblies 16A and 16B when pivotally engaged thereon as best seen in FIG. 2 of the drawings.

A reinforced plate edge 27 extends along the front free edge of the bottom plate 26 between the sidewalls 21 and 22 in front of the hereinbefore described pocket channels 25 as best seen in FIG. 4 of the drawings.

Figure 5:
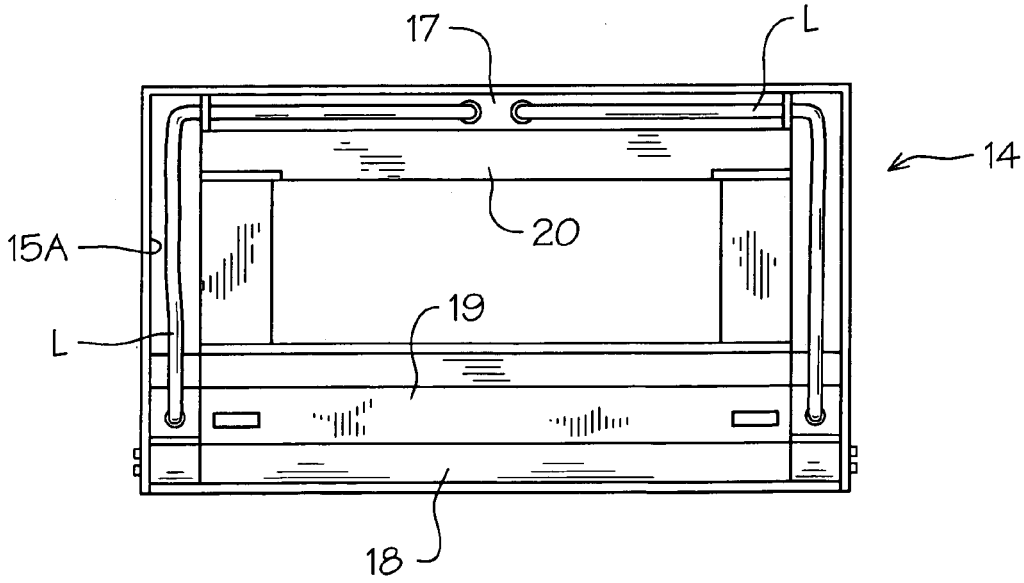
FIG. 5 is a rear elevational view thereof.

In operation, the material bucket 20 once secured to the pivoted mounting hook 28 extending from a loader 29 shown in FIG. 6 of the drawings is initially positioned in a down orientation resting on the horizontal arm portions 12A and 12B shown in FIGS. 2, 4 and 5 of the drawings. The main pivot pin P pivotally secures from the front of the bucket 20 to the arms 12A and 12B shown in broken lines in FIG. 2 of the drawings.

The hydraulic piston and cylinder assembly 16A and 16B respective rods are pivotally secured to corresponding aligned apertures A in the defined bucket channels 25 in offset vertical spaced relation to the main pivot pin P.

It will be evident that this spacing will allow the bucket 20 to pivot forward during the piston and cylinder activation as illustrated in FIGS. 1, 3 and 6 of the drawings increasing the relative dump access height to that of the arms 12A and 12B as they are extended from the boom of the loader 29 as opposed to a standard bucket attachment which typically pivots from the back of the bucket attachment as is well known in the art.

It will thus be seen that a new and novel high lift extending bucket attachment for loader equipment has been illustrated and described and it will be apparent to those skilled in the art that various changes and modifications may be made therein without departing from the spirit of the invention.

Therefore I claim:

1. A hydraulic bucket attachment for extended load delivery height comprises, an attachment frame having spaced parallel arms extending therefrom, a mounting bucket pivotally secured to the ends of said arms, said bucket in overlying engagement with said arms, hydraulic activator on said respective arms in longitudinal alignment thereto pivotally secured to said bucket adjacent said pivoting point of attachment of said arms to said bucket, said arms have an elongated area of uniform equal reduced cross-sectional dimension extending inwardly from said pivoting point of bucket attachment at their respective ends, said hydraulic activator in parallel aligned relation to said arms elongated area of uniform equal reduced cross-sectional dimension.

2. The hydraulic bucket attachment set forth in claim 1 wherein said arms are L-shaped.

3. The hydraulic bucket attachment set forth in claim 1 wherein said mounting bucket has spaced opposing sidewalls, a back wall interconnecting said sidewalls, a base bucket bottom plate extending between said sidewalls and said back wall and arm receiving channel within each of said sidewalls aligned for receiving said respective arms and hydraulic activators positioned therewithin.

4. The hydraulic bucket attachment set forth in claim 1 wherein said attachment frame comprises, parallel frame members extending between spaced parallel arms defining loader boom engagement surfaces therebetween.

* * * * *